US005244760A

United States Patent [19]

Nealey et al.

[11] Patent Number: 5,244,760

[45] Date of Patent: Sep. 14, 1993

[54] HIGH SENSITIVITY ELECTROPHOTOGRAPHIC IMAGING MEMBERS

[75] Inventors: Richard H. Nealey, Penfield; Martha J. Stegbauer, Ontario, both of N.Y.

[73] Assignee: Xerox Corporation, Stamford, Conn.

[21] Appl. No.: 815,793

[22] Filed: Jan. 2, 1992

[51] Int. Cl.[5] ..... G03G 5/047

[52] U.S. Cl. ..... 430/58; 430/59

[58] Field of Search ..... 430/58, 59

[56] References Cited

U.S. PATENT DOCUMENTS

| | | | |
|---|---|---|---|
| 4,026,702 | 5/1977 | van der Brink et al. . | |
| 4,540,652 | 9/1985 | Chuiko et al. | 430/84 |
| 4,613,556 | 9/1986 | Mort et al. | 430/57 |
| 4,647,521 | 3/1987 | Oguchi et al. | 430/58 |
| 4,859,553 | 8/1989 | Jansen et al. | 430/58 |
| 4,869,982 | 9/1989 | Murphy | 430/58 |

FOREIGN PATENT DOCUMENTS

| | | | |
|---|---|---|---|
| 185046 | 11/1982 | Japan | 430/58 |
| 158458 | 8/1985 | Japan | 430/58 |
| 140943 | 6/1986 | Japan | 430/58 |
| 251860 | 11/1986 | Japan | 430/58 |
| 1362682 | 8/1974 | United Kingdom . | |
| 1484906 | 9/1977 | United Kingdom . | |

OTHER PUBLICATIONS

Photocarrier Generation Process of Phthalocyanine Porticles Dispersed in a Polymer: Effects of Pigment Particle Size, Polymer Matrix and Addition of Fine x-Alumina Particles, Saito et al. (May 25, 1991).

*Primary Examiner*—Roland Martin

[57] ABSTRACT

An electrophotographic imaging member comprising a charge generating layer and a charge transport layer, the charge generating layer comprising organic photoconductive particles, a film forming binder and inorganic oxide particles.

9 Claims, No Drawings

HIGH SENSITIVITY ELECTROPHOTOGRAPHIC IMAGING MEMBERS

BACKGROUND OF THE INVENTION

This invention relates in general to electrophotographic imaging members and more specifically, to electrophotographic imaging members having higher sensitivity.

Multiple layered electrophotographic imaging members comprising photogenerating layers and transport layers deposited on conductive substrates are also well known in the art and are extensively described in the patent literature, for example, in U.S. Pat. No. 4,265,990. These devices usually comprise a substrate having a conductive layer, an optional charge blocking layer, an optional adhesive layer, a charge generating layer, and a charge transport layer and, in some embodiments, an anti-curl backing layer.

Although excellent toner images may be obtained with multilayered belt photoreceptors, it has been found that as more advanced, higher speed electrophotographic copiers, duplicators and printers were developed, the need for higher sensitivity photoreceptors became greater. Moreover, high sensitivity photoreceptors are desirable for low speed copiers and printers because less power is consumed to expose the photoreceptor. Further, simpler, more compact and less expensive electromagnetic radiation sources may be utilized. Generally, multilayered photoreceptors tend to have a relatively soft photoinduced discharge curve (PIDC). A photoinduced discharge curve obtained by charging a photoreceptor to a given voltage and then exposing to light and plotting the remaining voltage as a function of light exposure. Typically such a curve is characterized by 1) an initial straight portion of the curve associated with sensitivity, S, and 2) the point at which the slope of the initial straight line portion decreases to a value of ½ the initial slope, described as the critical voltage $V_c$ and a residual voltage $V_r$ which is the voltage remaining after an excess of light is used to discharge the photoreceptor. Thus, the lower the $V_c$ than the sharper the PIDC. Typically a composite index of curve slope is used which is the ratio of Vc/S. Thus the lower the value of Vc/S, the sharper a curve is said to be. Typically a Vc/S value of approximately 2 or greater would be considered a "soft PIDC". A softer PIDC curve shape indicates that the photoreceptor is less sensitive and requires more light or longer exposure. Thus, a less sensitive photoreceptor will not discharge as much as a more sensitive photoreceptor. Further, insufficient discharge of a photoreceptor results in higher residual charge after a conventional light exposure erase step. High residual charge or potential can be a cause of high background in prints. Thus, there is a continuing need for an electrophotographic imaging member having improved sensitivity.

INFORMATION DISCLOSURE STATEMENT

U.S. Pat. No. 4,026,702 to van den Brink et al., issued May 31, 1977—A photoconductive element is disclosed comprising a support and a photoconductive layer. the photoconductive layer comprises photoconductive cadmium sulfide or cadmium sulfoselenide dispersed in an organic polymeric binder and hydrophobic colloidal silica. The colloidal silica is used in amounts sufficient to enhance the electrophotographic properties of the photoconductive layer.

U.S. Pat. No. 4,540,652 to Chuiko et al., issued Sep. 10, 1985—An electrically conductive support and a dielectric layer are disclosed in which the dielectric layer contains a polymeric binder and a pigment in the form of finely divided silicon and titanium oxide.

U.S. Pat. No. 4,613,556 to Mort et al., issued Sep. 23, 1986—A multi-layered amorphous silicon photoresponsive imaging member is disclosed. The layered imaging member consists essentially of amorphous silicon in contact with a layer comprised of silicon dioxide (e.g. see column. 3, line 63–column. 4, line 2).

U.S. Pat. No. 4,859,553 to Jansen et al., issued Aug. 22, 1989—A photoresponsive imaging member is disclosed comprising a supporting substrate in contact with a layer comprising a photogenerative substance dispersed in a charge transport material comprised of plasma deposited silicon oxides (e.g. see column. 5, lines 28–34).

SUMMARY OF THE INVENTION

It is, therefore, an object of the present invention to provide an improved electrophotographic imaging member which overcomes the above-noted deficiencies.

It is yet another object of the present invention to provide an improved electrophotographic imaging member that is more sensitive to activating radiation.

It is still another object of the present invention to provide an improved electrophotographic imaging member which discharges to a greater degree.

It is another object of the present invention to provide an improved electrophotographic imaging member that exhibits less residual charge after exposure.

It is yet another object of the present invention to provide an improved electrophotographic imaging member which has a lower value for Vc/S thereby a sharper PIDC curve.

The foregoing objects and others are accomplished in accordance with this invention by providing an electrophotographic imaging member comprising a charge generating layer and a charge transport layer, the charge generating layer comprising organic photoconductive particles, a film forming binder and inorganic oxide particles.

Any suitable multilayered electrophotographic imaging member may utilize the charge generation layer of this invention. Generally, a multilayered electrophotographic imaging member comprises a substrate having a conductive surface, an optional charge blocking layer, an optional adhesive layer, a charge generating layer, and a charge transport layer.

The substrate may be opaque or substantially transparent and may comprise numerous suitable materials having the required mechanical properties. Accordingly, this substrate may comprise a layer of a non-conductive or conductive material such as an inorganic or an organic composition. If the substrate comprises non-conductive material, it is usually coated with a conductive composition. As insulating non-conducting materials there may be employed various resins known for this purpose. The insulating or conductive substrate may be flexible or rigid and may have any number of many different configurations such as, for example, a plate, a cylindrical drum, a scroll, an endless flexible belt, and the like.

The thickness of the substrate layer depends on numerous factors, including economical considerations, and thus this layer may be of substantial thickness, for example, over 200 microns, or of minimum thickness less than 50 microns, provided there are no adverse affects on the final photoconductive device.

A conductive layer or ground plane may comprise the entire substrate layer or be present as a coating on a non-conductive layer and may comprise any suitable material including, metals, carbon black, graphite and the like. The conductive layer may vary in thickness over substantially wide ranges depending on the desired use of the electrophotographic member. Accordingly, the conductive layer can generally range in thickness of from about 50 Angstroms to many centimeters. These conductive layers are well known and described, for example in U.S. Pat. No. 4,515,882.

After formation of an electrically conductive surface, a hole blocking layer may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as those disclosed in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, duPont 49,000 (available from E. I. duPont de Nemours and Company), Vitel PE-100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

The charge generating (photogenerating) layer of this invention may be applied to the adhesive or blocking layer and thereafter be overcoated with a contiguous hole transport layer as described hereinafter. The charge generating layer of this invention comprises vanadyl phthalocyanine particles, a film forming binder and silicon dioxide particles. Surprisingly, the addition of inorganic oxide particles to charge generating layers containing inorganic photoconductive particles such as selenium show no change in sensitivity or dark decay properties.

Any suitable polymeric film forming binder material may be employed as the continuous matrix in the charge generating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as phenoxy resins polycarbonates, polyurethanes, polystyrenes, polyaryletherS, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, phenoxy resins, epoxy resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

Preferably, the inorganic oxide particle is silicon dioxide. Generally, the average particle size of silicon dioxide particles is less than about 0.01 micrometer. The silicon dioxide particles may be fumed silica. The silicon dioxide particles may be hydrophobic. These materials are wettable by organic solvents but not wet by water. Thus, these materials will agglomerate when placed in water. A typical example of silicon dioxide particles having a oleophilic surface is Cab-O-Sil, PTG grade, available from Cabot Corporation. These silicon dioxide particles are readily dispersed and remain in suspension in organic solvents. Generally, the silicon dioxide particles are treated with an organic material. In one embodiment, the silicon dioxide particles have at least a portion of the silicon atoms on the outside surface of the particles directly attached to one to three hydrocarbon or substituted hydrocarbon groups. The silicon dioxide particles may be produced by any suitable technique such as the aqueous sodium silicate solution precipitation and silica tetrachloride high temperature oxidation processes. One well known high temperature technique for forming the silicon dioxide particles includes flame hydrolysis decomposition of pure silicon tetrachloride in the gaseous phase in an oxyhydrogen flame at about 1,100° C.

Silicon dioxide particles have numerous silanol groups on the particle surfaces that are available for reaction with organosilicon compounds. For example, submicroscopic silicon dioxide particles having a diameter between about 10 and about 40 millimicrometers formed by flame hydrolysis have about one silanol group per about 28 to about 33 $A.^2$. This amounts to about 2,000 silanol groups per silicon dioxide particle. Upon exposure of freshly prepared submicroscopic silicon dioxide particles to the ambient atmosphere, chemisorbed water molecules become attached to the silanol groups. The presence of water molecules causes a chemical reaction to occur between the water molecules and the organosilicon compounds rather than between the silanol groups and the organo silicon compounds. Thus, the sooner freshly prepared colloidal silica particles are reacted with the organo silicon compounds, the greater number of silanol groups will be available for reaction with the organo silicon compound. The chemical attachment of hydrocarbon or substituted hydrocarbon groups to at least a portion of the silicon atoms on the surface of the silicon dioxide particles may be accomplished by any suitable technique. In one technique, silicon dioxide particles freshly obtained by the flame hydrolysis process described above are separated in a cyclone separator from the bulk of the hydrochloric acid also formed during the process. The silicon dioxide particles; at least one organosilicon compound having hydrocarbon or substituted hydrocarbon groups as well as hydrolyzable groups attached to a silicon atom such as dimethyl dichlorosilane; and steam are pneumatically introduced in parallel flow into a fluidized bed reactor heated to about 400° C. by means of an inert gas such as nitrogen. The organosilicon compound reacts with silanol groups on the surface of the silicon dioxide particles and chemical attachment between the silicon atom in the organosilicon compound and a silicon atom in the silicon dioxide particle occurs through an oxygen atom. Where the organosilicon compounds have more than one hydrolyzable group attached to each silicon atom in the organosilicon compound, there is a possibility that (1) the silicon atom in the organosilicon compound may be chemically attached to two silicon atoms in the silicon particle through silicon-oxygen-silicon bonding; (2) the silicon atom in the organosilicon compound may be bonded to a silicon atom in the silicon dioxide particle and to a silicon atom in another organosilicon compound through silicon-oxygen-silicon bonding; or (3) the silicon atom in the organosilicon compound may be attached to a silicon atom in the silicon dioxide particle through a silicon-oxygen-silicon bond and the remaining hydrolyzable groups may be hydrolyzed leaving hydroxyl groups attached to the silicon atom of the organosilicon compound. Where an organosilicon compound having two hydrolyzable groups such as dimethyl dichlorosilane is employed, it is believed that the silicon atoms in two adjacent organosilicon compound molecules are attached through silicon-oxygen-silicon bonding to each other as well as to silicon atoms in a silicon dioxide particle. In any event, at least one hydrophobic hydrocarbon or substituted hydrocarbon group is chemically attached by silicon-oxygen-silicon bonding to a silicon atom in the silicon dioxide particle.

The marked difference in characteristics between ordinary silicon dioxide particles and silicon dioxide particles in which silanol groups have been reacted with organosilicon compounds may be illustrated by placing the reacted and unreacted particles in a beaker of water. When unreacted submicroscopic silicon dioxide particles formed by the flame hydrolysis process described above is placed in a beaker of water, the particles are immediately wetted by the water and sink to the bottom of the beaker. However, when another sample of substantially identical silicon dioxide particles are treated with dimethyl dichlorosilane so that approximately 75 percent of the silanol groups on the surface of the silicon dioxide particles are chemically reacted with the silane, the treated silicon dioxide particles will float indefinitely on the surface of the water in the beaker.

Any suitable hydrocarbon or substituted hydrocarbon organic group directly attached to a silicon atom in the organosilicon compound may be employed to render silicon dioxide particles hydrophilic. The organic groups may comprise saturated or unsaturated hydrocarbon groups or derivatives thereof. Saturated organic groups include methyl, ethyl, propyl, butyl, bromomethyl, chloromethyl, chloroethyl and chloropropyl groups. Typical unsaturated organic groups include: vinyl, chlorovinyl, allyl, allyl-phenyl, and methacryloxypropyl. The size of the organic group attached to a silicon atom in the organosilicon compound depends on numerous factors such as the number of organic groups attached to the silicon atom, the likelihood of steric hindrance occurring, the number of silanol groups to be reacted, and the like. The principle criteria is that at least about 5 percent of the silanol groups on the silicon dioxide particles are reacted with the organosilicon compound. Any suitable hydrolyzable groups may be attached to the silicon atom of the organosilicon compound. Typical hydrolyzable groups include: chloro, bromo, ethoxy, methoxy, propoxy, propyloxy, acetoxy and amino groups. Examples of typical organosilicon compounds having an organic group attached directly to a silicon atom and hydrolyzable groups attached to a silicon atom include: dimethyl dichlorosilane, trimethyl chlorosilane, methyl trichlorosilane, allyl dimethylchlorosilane, hexamethyldisilazane, allylphenyldichlorosilane, benzyldimethylchlorosilane, bromomethyldimethylchlorosilane, alpha-chloroethyltrichlorosilane, beta-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyl-tris (beta-methoxyethoxy) silane, gamma-methacryloxypropyltrimethoxysilane, vinyltriacetoxysilane, divinyldichlorosilane, and dimethylvinylchlorosilane.

The metal oxide particles employed in the charge generating layer of this invention may be of any suitable shape. Typical shapes include spherical, granular and irregular particles. With reference to silicon dioxide particles, it is apparent that other material may be present in minor amounts. For example, if desired, a mixture of silicon dioxide and aluminum oxide may be formed by mutual flame hydrolysis of silicon tetrachloride and aluminum chloride. Analysis by X-ray indicates that the silicon dioxide particles formed by flame hydrolysis are amorphous.

The organic photogenerating particles are present in the resinous binder composition in various amounts, generally, however, satisfactory results may be achieved when the charge generating layer contains between about 20 percent by weight and about 50 percent by weight photoconductive organic pigment particles based on the total weight of the charge generating layer. At proportions greater than about 50 percent by weight photoconductive organic pigment particles, the photoreceptor exhibits higher dark decay and poorer charge acceptance. Preferably, the charge generating layer contains between about 30 percent by weight and about 35 percent by weight organic photoconductive particles. Also, when the photoconductive pigment particle to binder ratio is greater than about 50 percent by weight, the rheological properties of the charge generating layer rheological properties are more difficult to apply by some coating techniques such as dip coating.

Satisfactory results may be achieved when the charge generating layer comprising between about 25 percent by weight and about 50 percent by weight pigment, between about 5 percent by weight and about 30 percent by weight silicon dioxide and between about 70 percent by weight and about 20 percent by weight of film forming binder. Preferably, the charge generating layer comprises between about 30 percent by weight and about 40 percent by weight of organic photoconductive particles, between about 10 percent by weight and about 20 of hydrophilic silicon dioxide particles and between about 60 percent by weight and about 40 percent by weight film forming binder based on the total weight of the solids composition. Typical ratios of organic photoconductive pigment to silicon dioxide particles to film forming binder ratio are 35:20:45, 35:10:55 and 35:30:30 by weight. These ratios are particularly applicable to combinations of vanadyl phthalocyanine pigment particles, silicon dioxide particles, phenoxy resin binder. A satisfactory range proportions of silicon dioxide particles to binder by weight is between about 5:60 and about 2:3. Typically, the proportions are between about 10:55 and about 20:45.

If desired, small molecule charge transport material may be included in the continuous matrix. However, it is believed that small molecule charge transport material tend to migrate into the charge generating layer when applied as a component of the charge transport layer. Any suitable charge transport small molecules may be added to the charge generating layer. Typical charge transport molecules include those listed below with reference to the charge transport layer. If charge transport molecules are added to the charge generating layer coating mixture, it is added in amounts of less than about 5 percent by weight based on the total solids content of the coating mixture.

Generally, the particle size of the photoconductive organic pigments and the inorganic oxide particles should be less than the thickness of the dried charge generating layer. Optimum results are achieved when the particle size is less than about 0.3 micrometer. The dried photogenerating layer containing the organic photoconductive particles and inorganic oxide particles dispersed in a continuous matrix of the resinous binder material generally ranges in thickness of from about 0.1 micrometer to about 5 micrometers, and preferably has a thickness of from about 0.3 micrometer to about 3 micrometers. Preferably, the applied charge generating layer has a thickness between about 0.7 micrometer and about 1.1 micrometer. The photogenerating layer thickness is related to binder and inorganic oxide particle content. Higher binder and inorganic oxide particle content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Preferably, the mixture is applied with the film forming binder dissolved in a solvent and the organic photoconductive particles and inorganic oxide particles dispersed in the binder solution. Any added charge transport small molecule is normally dissolved in the solvent also. Any suitable solvent may be employed. Typical solvents include chlorinated solvents such as methylene chloride, 1,2-dichloroethane, toluene, cyclohexanone, and the like. Drying of the deposited coating may be effected by any suitable conventional technique such as oven drying, infrared radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. Any suitable activating compound may be employed as an additive in electrically inactive polymeric materials to make these materials electrically active. These activating compounds are well known in the art. Typical activating compounds include, for example, aromatic amine compounds, hydrazone, triphenylmethane, bis(4-diethylamino-2-methylphenyl)-phenylmethane; 4'-4"-bis(diethylamino)-2',2"-dimethyltriphenylmethane, and the like. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 150,000.

If desired, the charge transport layer may comprise any suitable electrically active charge transport polymer instead of a charge transport monomer dissolved or dispersed in an electrically inactive binder Electrically active charge transport polymer employed as charge transport layers are described, for example in U.S. Pat. Nos. 4,806,443, 4,806,444, and 4,818,650, the entire disclosures thereof being incorporated herein by reference.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins have a molecular weight from about 20,000 to about 150,000, more preferably from about 50,000 to about 120,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

The solvent utilized for applying the charge transport layer composition should preferably swell the film forming binder of the charge generating layer if the charge generating layer does not already contain a small molecular charge transport material. Swelling facilitates migration of some of the small molecule charge transport molecules from the charge transport layer into the charge generating layer.

Examples of photosensitive members having at least two electrically operative layers include a charge generator layer and diamine containing transport layer members disclosed in U.S. Pat. Nos. 4,265,990, 4,233,384, 4,306,008, 4,299,897 and 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

Optionally, an overcoat layer may also be utilized to improve resistance to abrasion. In some cases an anti-curl back coating may be applied to the side opposite the photoreceptor to provide flatness and/or abrasion resistance on web type photoreceptors. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers. The thickness of anti-curl backing layers should be sufficient to substantially balance the total forces of the layer or layers on the opposite side of the supporting substrate layer.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A vanadyl phthalocyanine/phenoxy binder charge generating layer device was prepared. A mixture of 7.11 grams vanadyl phthalocyanine pigment, 56 ml of 1,1,2trichloroethane and 368 ml $CH_2Cl_2$ was stirred in a Silverson dispersator for ½ hour and then passed once through a Microfluidics laboratory homogenizer (Model 110F) at 8000 psig pressure. Independently, 5.27 grams of phenoxy resin (available as UCAR phenoxy resin, PKHH from Union Carbide) was dissolved in 185 ml of $CH_2Cl_2$ and 285 ml of 1,1,2trichloroethane. The two mixtures were combined and roll milled without shot for 12 hours.

This mixture was applied to an aluminum drum by spray coating to an optical density of 1.0 measured at 650 nm and dried at 120° C. for 1 hour. A charge transport layer consisting of a $CH_2Cl_2$ solution of N,N'-diphenyl-N,N'-bis(3-methylyphenyl)-(1,1'-biphenyl]-4,4'-diamine) in polycarbonate (Merlon M-50, available from Mobay Chemical Company) at a 35/65 weight ratio of N,N'-diphenyl-N,N'-bis(3-methylyphenyl)-(1,1'-biphenyl]-4,4'diamine) to polycarbonate was spray coated to a dried thickness of 18.8 micrometers after drying at 120° C. for 75 minutes. This device was then tested for typical photoreceptor properties in an electrical scanning device in which the photoreceptor was charged, exposed and erased with calibrated amounts of light.

EXAMPLE II

A set of drums were prepared using the same charge generator layer dispersion as described in Example I, but coated to an optical density of 1.3 as measured at 650 nm. The charge transport layer was applied to a thickness of 18.8 micrometers.

EXAMPLE III

A vanadyl phthalocyanine/phenoxy binder charge generating layer device was prepared with added $SiO_2$ particles. A mixture of vanadyl phthalocyanine, 3.98 grams $SiO_2$, 285 ml $CH_2Cl_2$ and 190 ml 1,1,2trichloroethane was stirred on a Silverson dispersator for ½ hour and then passed once through a Microfluidics laboratory homogenizer (Model 110F) at 8000 psig pressure. The $SiO_2$ particles had an average particles size of less than 0.3 micrometer. Independently, 8.95 grams of phenoxy resin was dissolved in 285 ml of $CH_2Cl_2$ and 190 ml of 1,1,2trichloroethane. The two mixtures were combined and roll milled without shot 12 hours. This mixture was applied by spray coating to an optical density of 1.0 as measured in the previous Examples. The transport layer composition as described in Example I was applied at a thickness of 17.4 micrometers.

EXAMPLE IV

A set of drums was prepared using the same charge generator layer dispersion as Example III but coated to an optical density of 1.3 as measured at 650 nm. The transport layer was applied to a thickness of 17.4 micrometers.

EXAMPLE V

A vanadyl phthalocyanine/polystyrene binder charge generating layer device was prepared. A mixture of 2.19 g vanadyl phthalocyanine in 180 ml of 1,2-dichloroethane was stirred on a Silverson dispersator for ½ hour and then passed once through a Microfluidics laboratory homogenizer (Model 110F) at 7500 psig pressure. Independently, 4.07 g polystyrene was dissolved in 270 ml $CH_2Cl_2$. The two mixtures were combined and roll milled without shot for 12 hours.

The resulting dispersion was applied to an aluminum drum by spray coating to an optical density of 1.0 optical density measured at 650 nm and dried at 120° C. for 1 hour. A transport layer solution consisting of N,N'-diphenyl-N,N'-bis(3-methylyphenyl)-(1,1'-biphenyl-4,4'diamine) and poly(4,4'-diphenyl-1,1'-cyclohexane carbonate) (available as lupilone Z-200 from, Mistibushi Gas Chemical Corp) at a 35/65 weight ratio in a 60/40 mixture of $CH_2Cl_2$/1,1,2-trichloroethane was spray coated to a dried thickness of 18 micrometers after drying at 120° C. for 75 minutes. The resulting drum was then tested for typical photoreceptor properties in an electrical scanning device in which the photoreceptor was charged, exposed and erased with calibrated amounts of light.

EXAMPLE VI

A vanadyl phthalocyanine/polystyrene/$SiO_2$ charge generating layer device was prepared. A mixture of 6.96 grams vanadyl phthalocyanine, 1.99 grams $SiO_2$ particles in 292 ml $CH_2Cl_2$ and 195 ml 1,2dichloroethane was stirred on a Silverson dispersator for ½ hour and then passed once through a Microfluidics laboratory homogenizer (Model 110F) at 8000 psig pressure. The $SiO_2$ particles had an average particles size of less than 0.3 micrometer. Independently, 10.93 grams polystyrene was dissolved in a mixture of 293 ml $CH_2Cl_2$ and 195 ml 1,2-dichloroethane. The two mixtures were combined and roll milled without shot for 12 hours.

This mixture was then spray coated on an aluminum drum to an optical density of 1.0 as measured in previous Examples. A transport layer as described in Example VI was applied at a dried thickness of 18 micrometers. The resultant drum was then tested for typical photoreceptor properties in an electrical scanning device in which the photoreceptor was charged, exposed and erased with calibrated amounts of light.

EXAMPLE VII

A vanadyl phthalocyanine/polystyrene/$SiO_2$ charge generating layer device was prepared. This mixture was prepared by an identical process as described in Example VI except the amount of $SiO_2$ particles was increased to 3.98 grams and the amount of polystryrene was reduced to 8.95 grams. Drums were coated to a charge generation layer optical density of 1.0 as measured at 650 nm and a charge transport layer identical to that described in Example V was applied to a dried thickness of 18 micrometers. The drum was then tested for typical photoreceptor properties in an electrical scanning device in which the photoreceptor was charged, exposed and erased with calibrated amounts of light.

EXAMPLE VIII

The compositions of the charge generator layers and the results of the electrical tests of the photoreceptors described in Examples I through VII above are tabulated below in Tables 1 and 2, respectively.

TABLE 1

| Charge Generating Layer | Vanadyl phthalocyanine (wt %) | Binder (wt %) | $SiO_2$ (wt %) |
|---|---|---|---|
| Example I | 57 | 43 | 0 |
| Example II | 57 | 43 | 0 |
| Example III | 35 | 45 | 20 |
| Example IV | 35 | 45 | 20 |
| Example V | 35 | 65 | 0 |
| Example VI | 35 | 55 | 10 |
| Example VII | 35 | 45 | 20 |

TABLE 2

| Example | $V_o$ | % DD | % Discharge | S | $V_c/S$ | $V_e$ |
|---|---|---|---|---|---|---|
| I | 764 | 10 | 63.5 | 92 | 2.55 | 19 |
| II | 822 | 7.5 | 50.5 | 79 | 3.9 | 23 |
| III | 509 | 22 | 88.8 | 113 | 1.2 | 9.75 |
| IV | 595 | 15 | 83.4 | 100 | 1.6 | 12 |
| V | 670 | 16 | 75.2 | 102 | 1.9 | 18 |
| VI | 524 | 24 | 82.4 | 81 | 1.8 | 14 |
| VII | 478 | 27 | 86 | 83 | 1.6 | 12 |

$V_o$ is the potential to which the photoreceptor is charged.

DD (dark decay) is the change in $V_o$ in the dark for a 0.35 sec duration beginning at 0.22 sec after charging and is expressed as a percent of $V_o$.

% Discharge represents that percentage of the initial voltage that is discharged by the application of 6 ergs/cm$^2$ of 800 nm light. Thus, a higher % discharge represents a more sensitive device.

S (Sensitivity) is the initial slope of the PIDC curve and is expressed in V/erg/cm$^2$.

Vc/S is the curve shape factor and is obtained by dividing the $V_c$ value by the initial sensitivity.

$V_e$ is the voltage remaining after exposure to an excess of 800 nm light i.e. a fully light discharged value.

The sensitivity as measured by the percent of discharge $V_{BG}/V_{DDP}$ for 6 ergs exposure showed that significantly more discharge was obtained with the charge generator layers containing the added $SiO_2$ particles than for charge generator layers that did not contain $SiO_2$ particles. The curve shape as measured by Vc/S was significantly decreased, i.e., a sharper PIDC curve was obtained in the phenoxy system and a slight decrease was seen in the polystyrene system. There was a significant decrease in both erase residual voltages and PIDC residual voltages in both systems when $SiO_2$ was added.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a charge generating layer between a support layer and a charge transport layer, said charge generating layer comprising photoconductive vanadyl phthalocyanine particles, a film forming binder and silicon dioxide particles having an average particles size of less than about 0.3 micrometer.

2. An electrophotographic imaging member according to claim 1 wherein said charge generating layer comprises between about 20 percent by weight and about 50 percent by weight photoconductive vanadyl phthalocyanine particles based on the total weight of said charge generating layer.

3. An electrophotographic imaging member according to claim 1 wherein said said charge generating layer comprises between about 30 percent by weight and about 35 percent by weight photoconductive vanadyl phthalocyanine particles based on the total weight of said charge generating layer.

4. An electrophotographic imaging member according to claim 1 wherein the outer surface of said silicon dioxide particles is oleophilic.

5. An electrophotographic imaging member according to claim 1 wherein at least one hydrophobic hydrocarbon or substituted hydrocarbon group is chemically attached by silicon-oxygen-silicon bonding to silicon atoms at the outer surface of said silicon dioxide particles.

6. An electrophotographic imaging member according to claim 5 wherein said silicon dioxide particles comprise the reaction product of silanol groups on the outer surface of said silicon dioxide particles and a hydrolyzed organosilicon compound and at least about 5 percent of said silanol groups on said silicon dioxide particles are reacted with said hydrolyzed organosilicon compound.

7. An electrophotographic imaging member according to claim 6 wherein said organosilicon compound comprises hydrocarbon or substituted hydrocarbon groups as well as hydrolyzable groups attached to a silicon atom.

8. An electrophotographic imaging member according to claim 1 wherein said charge generating layer comprises between about 25 percent by weight and about 50 percent by weight of said photoconductive vanadyl phthalocyanine particles, between about 5 percent by weight and about 30 percent by weight said silicon dioxide particles and between about 70 percent by weight and about 20 percent by weight of said film forming binder, based on the total weight of said charge generating layer.

9. An electrophotographic imaging member according to claim 1 wherein said said charge generating layer comprises between about 30 percent by weight and about 40 percent by weight of said photoconductive vanadyl phthalocyanine particles, between about 10 percent by weight and about 20 percent by weight said silicon dioxide particles and between about 60 percent by weight and about 40 percent by weight of said film forming binder, based on the total weight of said charge generating layer.

* * * * *